US005186188A

United States Patent [19]

Fasolt

[11] Patent Number: 5,186,188

[45] Date of Patent: Feb. 16, 1993

[54] HAIR CURLER

[76] Inventor: Eva Fasolt, Schiffmuhlenstrasse 53, A-1200 Vienna, Austria

[21] Appl. No.: 659,304

[22] PCT Filed: Nov. 17, 1989

[86] PCT No.: PCT/AT89/00104

§ 371 Date: May 14, 1991

§ 102(e) Date: May 14, 1991

[87] PCT Pub. No.: WO90/05468

PCT Pub. Date: May 31, 1990

[30] Foreign Application Priority Data

Nov. 17, 1988 [AT] Austria ..... 2821/88

[51] Int. Cl.[5] ..... A45D 6/14

[52] U.S. Cl. ..... 132/251; 132/245

[58] Field of Search ..... 132/245, 248, 250, 251, 132/254

[56] References Cited

U.S. PATENT DOCUMENTS

| | | | |
|---|---|---|---|
| 2,369,752 | 2/1945 | Ostrander | 132/248 |
| 2,652,840 | 9/1953 | Isaacs et al. | 132/248 |
| 3,064,659 | 11/1962 | Solomon | 132/251 |
| 3,123,079 | 3/1964 | Buesgen | 132/251 |
| 4,732,169 | 3/1988 | Van Sickle | 132/248 |

FOREIGN PATENT DOCUMENTS 3301592 7/1984 Fed. Rep. of Germany .

*Primary Examiner*—Gene Mancene
*Assistant Examiner*—Frank A. LaViola
*Attorney, Agent, or Firm*—Cushman, Darby & Cushman

[57] ABSTRACT

A hair curling device including an elongated cylindrical body having first and second ends, and first and second flange members being affixed to the first and second ends respectively. Each of the flange members includes a plurality of bores disposed in a peripheral surface thereof and are parallel to the longitudinal axis of the body. The bores of the first flange member are disposed coaxially with the bores of the second flange member, and each bore extends uniformly from an outer periphery of the flange members to an outer peripheral surface of the body. Each bore has an opening at an outer peripheral surface of the flange members, and an inside width of the opening is smaller than the diameter of the bores.

8 Claims, 1 Drawing Sheet

HAIR CURLER

The invention is relative to a hair curler with an essentially cylindrical, preferably hollow cylindrical rolling body optionally provided with perforations, with flanges in the area of both its ends which are provided with bores running parallel to the axis of the rolling body and preferably arranged so that they are distributed at regular intervals over the circumference of the flanges. The bores of the two flanges are arranged coaxially to each other and at least one rod can be pressed into said bores.

Such a hair curler is known e.g. from DE-OS 33 01 592. In this curler, a single thin, small rod can be inserted laterally parallel to the curler axis into one of the bores in the one flange, stuck through the completely wound-up hair strand and engaged in the aligned bore of the opposite flange.

Furthermore, U.S. Pat. No. 3,123,079 teaches a hair curler with flanges set on the ends of the hair curler and comprising barbs which hold the hair strand fast.

All these known hair curlers have the sole purpose of fixing a hair strand wound in one direction on the rolling body.

It has been shown, however, that it is better for hairdos with very full curls if the individual hair strands are rolled in a broken fashion, that is, if a part of the length of the hair strand is first rolled in one direction and thereafter a further part of the length of the hair strand is rolled in the opposite direction. However, this is not possible with the known hair curlers.

The invention therefore has the problem of suggesting a hair curler of the initially mentioned type which makes it possible to roll a hair strand section-by-section with alternating direction of rolling onto a rolling body.

This is achieved by the invention in that the bores extend up to the outer circumference of the rolling body and are open-edged in the area of the outer jacket surfaces of the flanges and in that the inside width of these openings is slightly smaller than the diameter of the bores which corresponds to the diameter of the rods.

It is possible in this manner to roll a section of the hair strand which exhibits a length of e.g. 1.5 times the circumference of the rolling body onto said rolling body and to clamp it fast to the rolling body by means of a rod. Then, the hair strand is bent through 180°, rolled further in the other direction and clamped fast again by means of another rod before the next reversal of the direction of rolling, etc., until the hair strand has been completely rolled up in this manner. The direction of rolling can be changed as often as the length of the hair strand permits.

This possibility of rolling is created for the first time by the features of the invention. As a result of the fact that the open-edged bores in the flanges and overlapping the rods extend up to the outer circumference of the rolling body, it is possible for the first time to clamp partial sections of a hair strand fast in such a manner that they can not slide off the rolling body. By way of contrast, in the case of the known hair curlers, there is a wide slot between the insertable rods and the surface of the roller core which slot does not permit a hair strand which is not completely rolled up and sufficiently long to be clamped in.

It is further possible, as a result of the design feature that the bores are open-edged in the area of the outer jacket surfaces of the flanges and that the inside width of these openings is slightly smaller than the diameter of the bores which corresponds to the diameter of the rods, to press in a fixing rod again and again during the turning process even though the rolled height constantly increases in the course of the rolling.

According to a further feature of the invention, it can be provided that the diameter of the rods is at least one third of the diameter of the rolling body. As a result of this design, the bending strain on the hairs during a reversal of the direction of rolling can be considerably reduced.

It is especially advantageous if the rolling body and the flanges formed on them, preferably in a one-piece manner, as well as the rods are made of plastic. This results in advantages as regards a simple manufacture and also as regards their use, since plastics are not sensitive to the preparations used e.g. for permanent waves and since the relative softness and elasticity of the hair curlers results in correspondingly greater comfort.

The invention will now be explained in more detail with reference made to the drawings.

Figure 1:
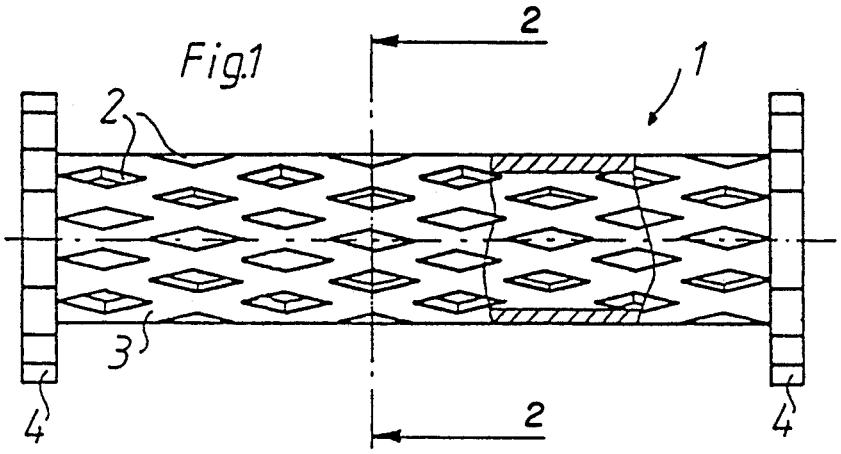
FIG. 1 shows a hair curler in accordance with the invention.
Figure 2:
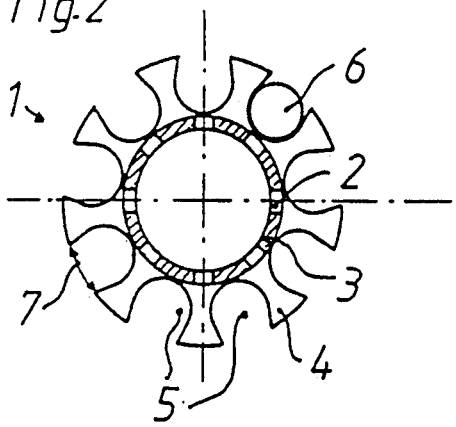
FIG. 2 shows a section along line A—B in FIG. 1.

In the embodiment according to FIGS. 1 and 2, hair curler 1 comprises a hollow cylindrical rolling body provided with perforations 2 and with flanges 4 at both its ends.

These flanges 4 are formed in one piece on rolling body 3, which is preferably manufactured from plastic but which can also be manufactured from other materials.

These flanges 4 ar provided with bores 5 which run axially or parallel to the axis of rolling body 3. Bores 5 are distributed essentially uniformly over the circumference of flanges 4. Bores 5 of both flanges 4 are in alignment with each other.

Figure 3:
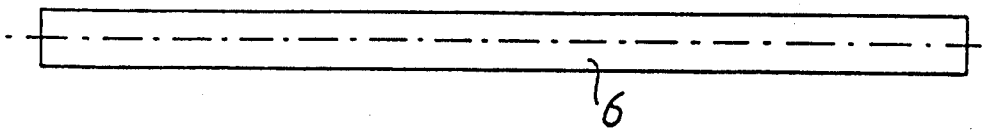
FIG. 3 shows a rod for use with a hair curler in accordance with FIGS. 1 and 2.

As a result thereof, rod 6, shown in FIG. 3, can be inserted into the bores of both flanges 4, as a consequence of which the direction in which a hair strand is rolled up can be changed, after the insertion of rod 6. The hair strand is then rolled thereby over inserted rod 6. The direction of rolling of a hair strand can also be changed several times thereby, provided that the strand is of an appropriate length, during which a rod 6 must be inserted into bores 5 of flanges 4 of rolling body 3 at each change of the direction of rolling.

As can be seen from FIG. 2, bores 5 of flanges 4 are designed to be open-edged in the area of their cylinder jacket surfaces and the inside width of openings 7 of bores 5 of flanges 4 is smaller than the diameter of the bores, so that rod 6 can be inserted radially into the bores of the flanges but can no longer fall out of them. The insertion of rods 6 takes place thereby under elastic widening of openings 7 of bores 5.

Figure 4:
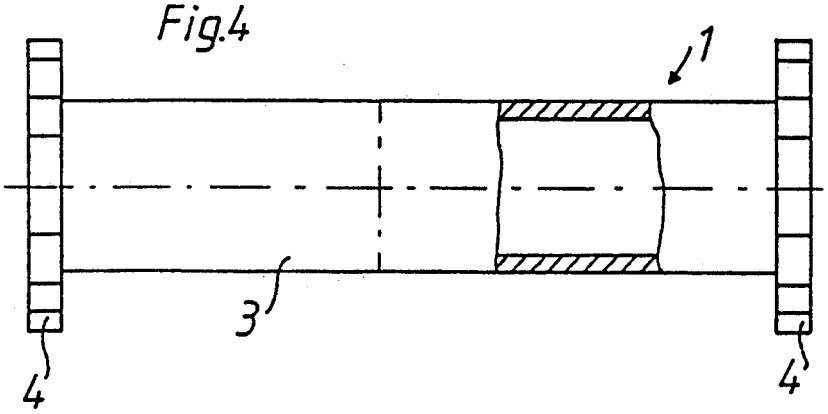
FIG. 4 shows another embodiment of a hair curler in accordance with the invention.

The embodiment according to FIG. 4 differs solely in that rolling body 3 does not comprise any radial openings, as is the case in the embodiment according to FIG. 1.

In order to fix the rolled-up hair strand, a rubber ring can be used in both instances which ring is tensioned over the webs of flanges 4 remaining between two bores 5 and holds the hair roll in contact with rolling body 3 by virtue of its tension. A sliding off of the rubber ring is prevented thereby by means of the widening out of the webs in their outer edge areas. The rubber ring constitutes a device for holding fast and clamping the hair strand.

I claim:

1. A hair curling device comprising:

an elongated cylindrical body having first and second ends; and first and second flange members being affixed to said first and second ends respectively, each of said flange members including a plurality of bores disposed in a peripheral surface thereof and being parallel to the longitudinal axis of said body, the bores of said first flange member being disposed coaxially with the bores of said second flange member, said bores extending uniformly from an outer periphery of said flange members to an outer peripheral surface of said body, said bores having an opening at an outer peripheral surface of said flange members, an inside width of said opening being smaller than the diameter of said bores.

2. A hair curling device as claimed in claim 1, in combination with at least one rod element, said rod element being disposed in said coaxially disposed bores, said rod element being parallel to the longitudinal axis of said body, the diameter of said rod elements size so as to be retained within said bores.

3. A hair curling device as claimed in claim 2, wherein the diameter of said rod elements is at least one third the diameter of said body.

4. A hair curling device as claimed in claim 1 or 3, wherein said flange members are formed integrally with said body.

5. A hair curling device as claimed in claim 1, wherein said body includes a bore therethrough, said bore being disposed along the longitudinal axis of said body, so as to make said body hollow.

6. A hair curling device as claimed in clam 5, wherein said body includes a plurality of perforations disposed in an outer peripheral surface thereof, said perforations extending to the bore of said body.

7. A hair curling device as claimed in claim 1, wherein said bores of said flange members are disposed uniformly about the periphery of said flange members.

8. A hair curling device as claimed in claim 1, wherein said body and said flange members are manufactured from plastic material.

* * * * *